US005841226A

United States Patent [19]

Hichiwa et al.

[11] Patent Number: 5,841,226

[45] Date of Patent: Nov. 24, 1998

[54] DEFLECTION YOKE

[75] Inventors: Tsutomu Hichiwa, Koga, Japan; Masahiko Nakagawa, Syouwa-machi, Japan; Masayuki Shimada, Koshigaya, Japan; Masaaki Itoh, Iwai, Japan

[73] Assignee: Victor Company of Japan, Ltd., Tokyo, Japan

[21] Appl. No.: 788,541

[22] Filed: Jan. 24, 1997

[30] Foreign Application Priority Data

Jan. 25, 1996 [JP] Japan ..... 8-032902

[51] Int. Cl.[6] ..... H01J 29/70; H01J 29/76

[52] U.S. Cl. ..... 313/440; 335/210; 335/213

[58] Field of Search ..... 313/440; 335/213, 335/210, 214

[56] References Cited

U.S. PATENT DOCUMENTS 2,799,798 7/1957 Kratz et al. ..... 313/440
4,096,462 6/1978 Akatsu et al. ..... 335/213
5,220,241 6/1993 Kanazawa et al. ..... 313/440
5,637,955 6/1997 Ji ..... 313/440

FOREIGN PATENT DOCUMENTS 51-65522 6/1976 Japan .

*Primary Examiner*—Nimeshkumar Patel
*Attorney, Agent, or Firm*—Michael N. Meller

[57] ABSTRACT

A deflection yoke is comprised of a separator for insulating horizontal and vertical deflection coils, the horizontal deflection coils of saddle type are provided within and top and bottom portion of the separator respectively, the separator has ribs for partly separating the top and bottom of horizontal deflection coils at their confronted portions, so that the confronted portions confront directly each other where the ribs are not present, thereby a magnetic field generated by the horizontal deflection coils is collected depending on a location and configuration of the ribs.

8 Claims, 11 Drawing Sheets

DEFLECTION YOKE

BACKGROUND OF THE INVENTION

1. Field of the invention

The present invention relates to a deflection yoke for a in-line 3-guns color picture tube, particularly relates to a deflection yoke for reducing misconvergence of the color picture tube.

2. Description of the prior art

Referring to FIGS. 1 through 7, a description is given of a self convergence type deflection yoke of a prior art for landing each of 3 beams respectively generated by in-line 3-guns on a screen of a color picture tube.

FIG. 1 shows a construction of a deflection yoke 1 for the in-line 3-guns color picture tube. The deflection yoke 1 has a funnel shape, and is comprised of a pair of separators 2, 2 each forming a large circular brim 1*a* and a small circular brim 1*b*. At an inside of the separators 2, 2, there is a pair of horizontal deflection coils 3, 3 (not shown in FIG. 1) in a form of saddle. Outside of the separators 2, 2, there is a pair of vertical deflection coils 4, 4 in a form of saddle. The separator 2 is made of resin, and isolates the pair of horizontal deflection coils 3, 3 from the pair of vertical deflection coils 4, 4. The pair of horizontal deflection coils 3, 3 are positioned above and below of the in-line 3-guns of the color picture tube. The pair of vertical deflection coils 4, 4 are positioned left and right thereof. Cores 5, 5 are disposed on each outside of the vertical deflection coils 4, 4. There are first and second flanges 6*a* and 6*b* near of the small circular brim 1*b*. Many parts are assembled to the first and the second flanges 6*a* and 6*b*. A circuit board 7 is clipped on the first flange 6*a*, hanging from the small circular brim 1*b* to the large circular brim 1*a*.

Such a deflection yoke as mentioned above is so called a saddle-saddle type.

As shown in FIG. 2(A), the pair of horizontal deflection coils 3, 3 has a saddle shape and positioned along an inner surface of the separator 2. The horizontal deflection coil 3 has a small rim 3*b*, a large rim 3*a*, and a window 3*d*. A bottom end of an intermediate portion 3*c* of the horizontal deflection coil 3 is formed by pressing in its production process to form a flat surface which is called a pressed plane 3*c*1 , and confronted with another pressed plane 3*c*1. As shown in FIG. 2(B), the pair of vertical deflection coil 4, 4 is similar to the pair of horizontal deflection coil 3, 3 in the shape, and positioned along an outer surface of the separator 2. The vertical deflection coil 4 has same portions of that of the horizontal deflection coil 3, such as a small rim 4*b*, a large rim 4*a*, a window 4*d*, and an intermediate portion 4*c*.

Functions of the horizontal deflection coil 3 and that of the vertical coil 4 are explained referring to FIGS. 3(A) and 3(B). FIGS. 3(A) and 3(B) show sectional views of the deflection yoke 1 and a neck part of a color picture tube 8 cut along the X-Y plane. FIG. 3(A) shows a magnetic field induced by the pair of horizontal deflection coil 3, 3. FIG. 3(B) shows a magnetic field induced by the pair of vertical deflection coil 4, 4.

In FIG. 3(A), two intermediate portions 3*c*, 3*c* shown above the X axis is one of the horizontal deflection coil 3, and two intermediate portions 3*c*, 3*c* shown below the X axis is the other horizontal deflection coil 3. The magnetic field induced by the pair of horizontal deflection coils 3, 3 has a pincushion distortion as shown in FIG. 3(A).

On the other hand, at each intermediate portions 4*c*, 4*c* of right and left sides of the Y axis, there are the vertical deflection coils 4, 4 respectively. The magnetic field induced by the pair of vertical deflection coil 4, 4 has a barrel distortion as shown in FIG. 3(B).

The deflection yoke 1 having such horizontal deflection coil 3 and vertical deflection coil 4 as the above adjusts a convergence of the color picture tube 8 by changing the magnetic field of the horizontal deflection coil 3 and/or the vertical deflection coil 4, by adding a circuit for adjustment to a horizontal deflection circuit and/or a vertical deflection circuit, and attaching a magnetic material to the color picture tube 8.

By these functions of the above, three electron beams of R, G, B emitted respectively from three electron guns land on a screen of the color picture tube 8.

FIG. 4 shows a frontal view of the deflection yoke 1 seen from the side of the large circular brim 1*a*. Here, only the separator 2 and the pair of horizontal deflection coils 3, 3 are shown for simplicity. Ribs 2*a*, 2*a* are provided inside of the separator 2 on the X axis thereof, for positioning the pair of horizontal deflection coil 3, 3 and isolating the pressed planes 3*c*1, 3*c*1 each other at a distance of more than 1 mm. The rib 2*a* is unitarily molded with the separator 2, extending from the large circular brim 1*a* to the small circular brim 1*b*.

FIG. 5 shows a sectional view of the deflection yoke 1 mounted on the color picture tube 8. The horizontal deflection coil 3, the vertical deflection coil 4 and the core 5 are shown here, and others are omitted for simplicity.

FIG. 6 shows a sectional view of the pair of horizontal deflection coils 3, 3 and a color picture tube 8 of the prior art taken along line A–A' of FIG. 5. The pair of horizontal deflection coils 3, 3 is separated each other in a predetermined distance by the ribs 2*a*, 2*a*.

Actual magnetic field induced by the pair of horizontal deflection coils 3, 3 is shown in FIG. 6. Horizontal deflection coils 3, 3 of the pair, are spaced each other by a distance "L" which is more than 1 mm as shown in FIG. 6. Under this condition and when convergence of horizontal R/B lines, R and B/G lines are attempted to be optimized, the pincushion distortion of the magnetic field in an area "a", corresponding to an area "a" of FIG. 5, is weakened. The same in an area "b", corresponding to an area "b" of FIG. 5, is, on the other hand, strengthened.

Owing to the distortion of the magnetic field of the above, at the right and left end zones of the screen, landing positions of red beam and blue beam do not agree with each other in the horizontal direction, as shown in FIG. 7, this is called a "B" type misconvergence.

The "B" type misconvergence is a serious problem for a deflection yoke of high definition display tube.

SUMMARY OF THE INVENTION

An object of the present invention is to provide a deflection yoke capable of reducing the "B" type misconvergence.

Another object of the present invention is to provide a deflection yoke which presents design flexibility of coil formation of a horizontal deflection coil.

Further and another object of the present invention is to provide a separator of a defection yoke capable of reducing the "B" type misconvergence.

A specific object of the present invention is to reduce the aforementioned problem by providing a deflection yoke having a pair of horizontal deflection coils of saddle type provided along one side of a separator, and a pair of vertical deflection coils provided along another side of the separator, wherein pressed planes of the pair of horizontal deflection coils are confronted closely with each other a part thereof.

Another specific object of the present invention is to reduce the aforementioned problem by providing a deflection yoke having a pair of horizontal deflection coils of saddle type provided along one side of a separator, and a pair of vertical deflection coils provided along another side of the separator, wherein the separator has ribs to keep a limited distance between the pressed planes of respective horizontal deflection coils of the pair.

Further and another specific object of the present invention is to reduce the aforementioned problem by providing a deflection yoke having a pair of horizontal deflection coils of saddle type provided along one side of a separator, and a pair of vertical deflection coils provided along another side of the separator, wherein the separator has ribs for keeping a limited distance between the pressed planes of respective horizontal deflection coils of the pair across the ribs.

DETAILED DESCRIPTION OF THE PREFERRED EMBODIMENT

Figure 1:
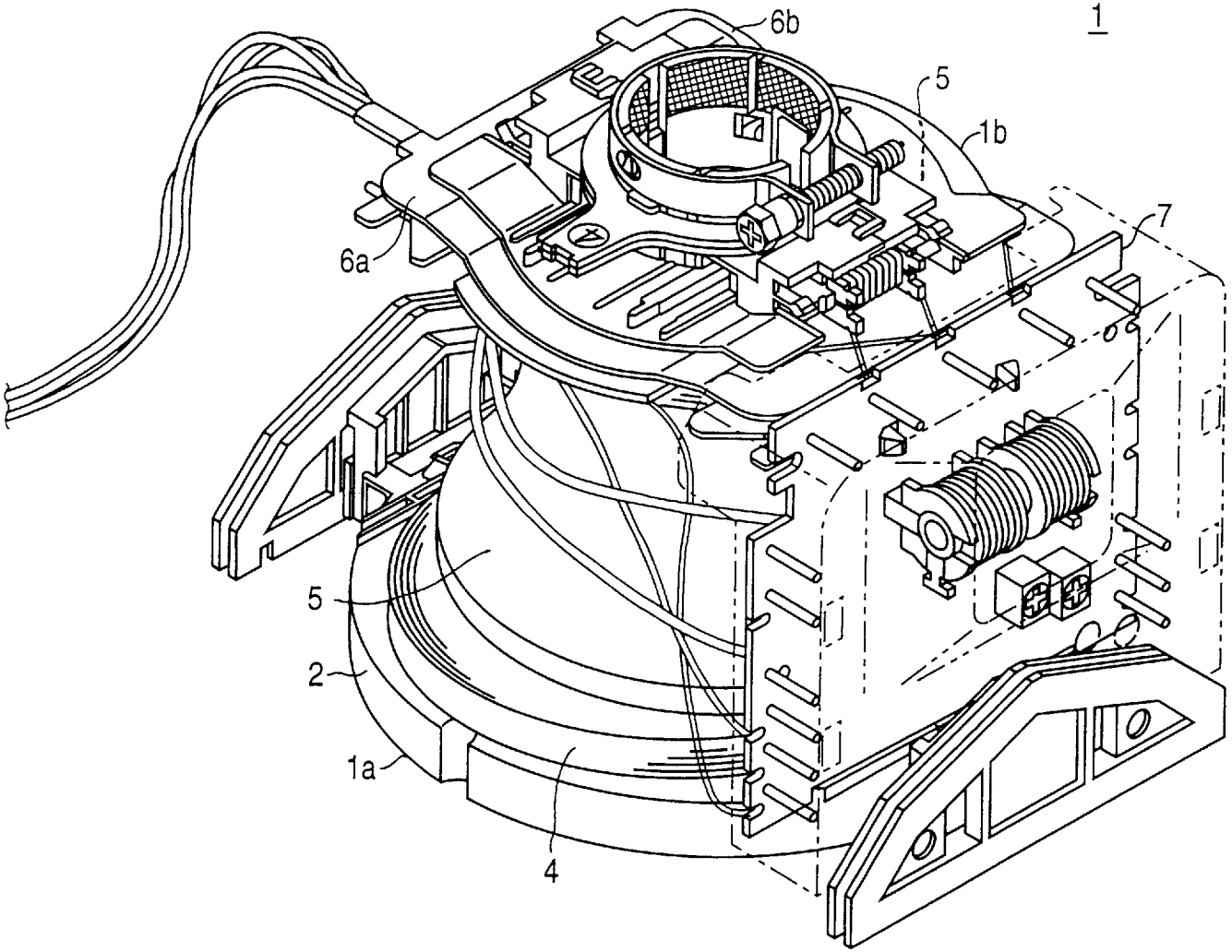
Fig. 1 PRIOR ART
FIG. 1 shows a perspective view of a deflection yoke of the prior art.
Figure 2A:
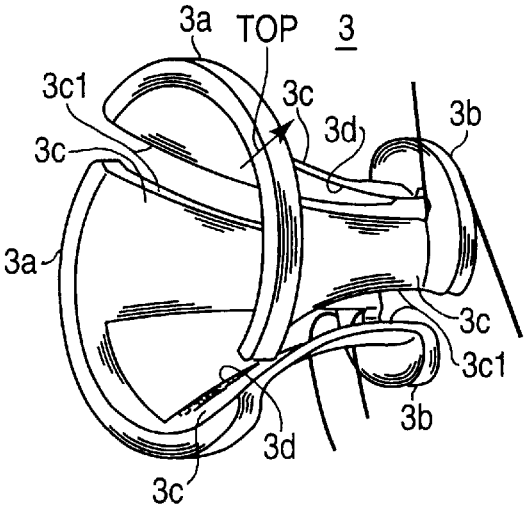
Fig. 2(A) PRIOR ART
FIG. 2(A) shows a pair of horizontal deflection coils of the prior art.
Figure 2B:
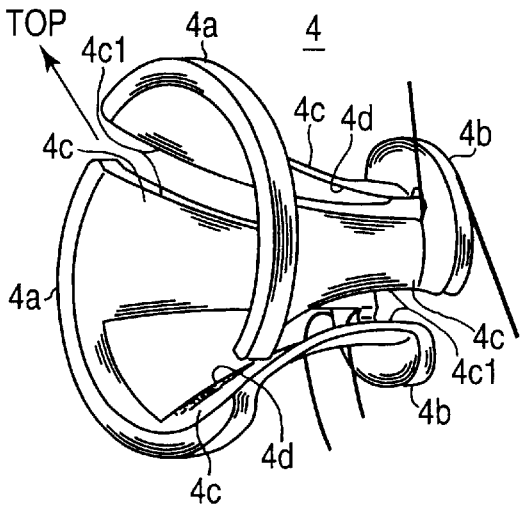
Fig. 2(B) PRIOR ART
FIG. 2(B) shows a pair of vertical deflection coils of the prior art.
Figure 3A:
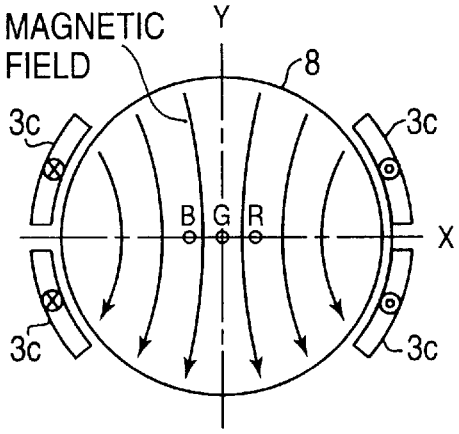
Fig. 3(A) PRIOR ART
FIG. 3(A) shows a magnetic field induced by a pair of horizontal deflection coils of the prior art.
Figure 3B:
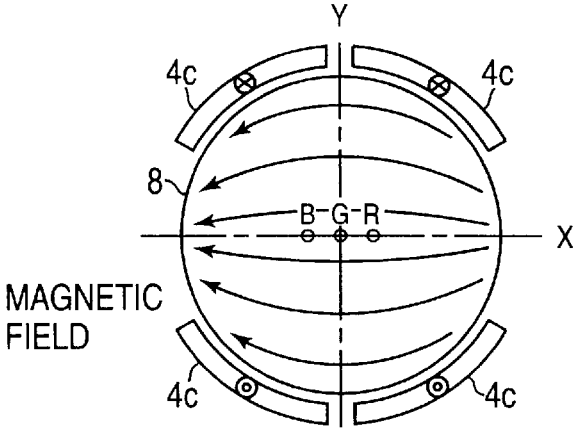
Fig. 3(B) PRIOR ART
FIG. 3(B) shows a magnetic field induced by a pair of vertical deflection coils of the prior art.

A deflection yoke according to the present invention will be described in detail with reference to the accompanying drawings, in which same reference numerals and symbols are used to denote like or equivalent elements used in the aforementioned prior arts, and detailed explanations of such elements are omitted for simplicity.

Figure 8:
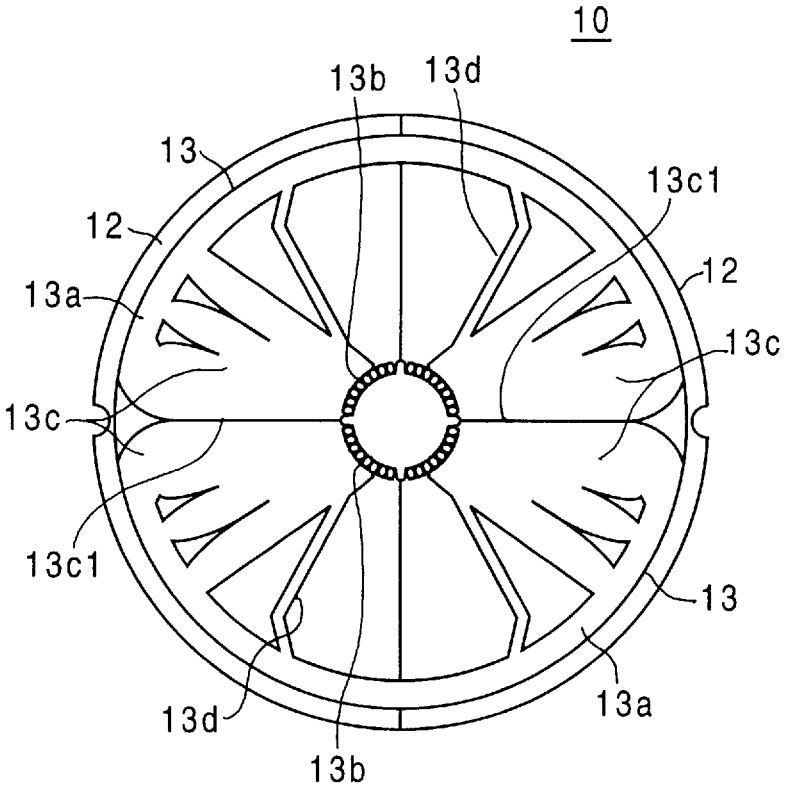
FIG. 8 shows a frontal view of a deflection yoke of first embodiment of the present invention seen from the side of a large brim.

FIG. 8 shows a frontal view of a deflection yoke of first embodiment of the present invention seen from the side of a large brim.

Figure 9A:
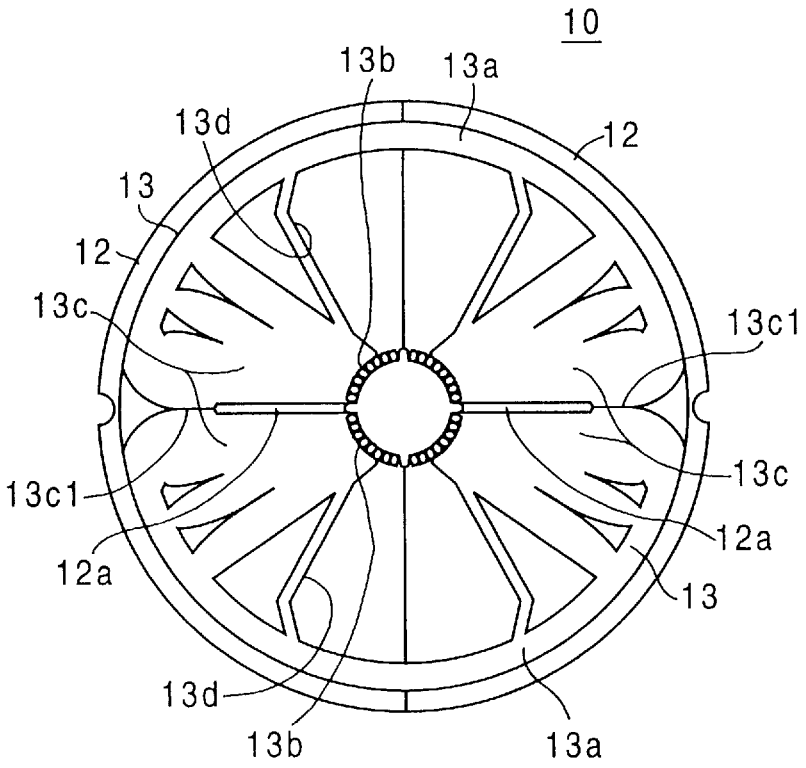
FIGS. 9(A) and 9(B) show frontal and sectional views of a deflection yoke of second embodiment of the present invention.
Figure 9B:
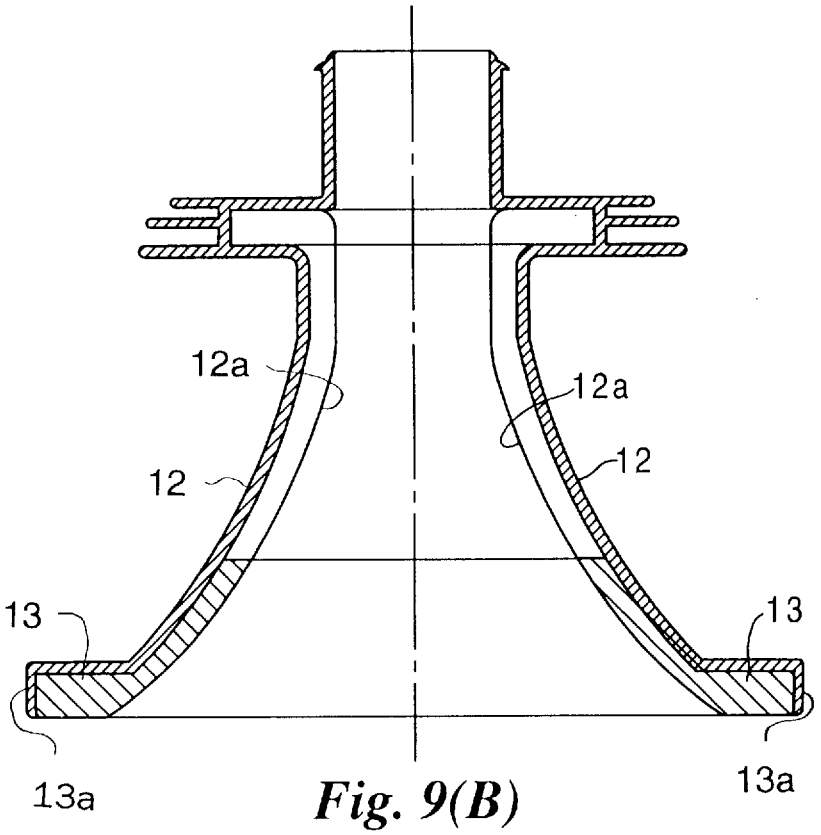

FIGS. 9(A) and 9(B) show frontal and sectional views of a deflection yoke of second embodiment of the present invention.

Figure 10:
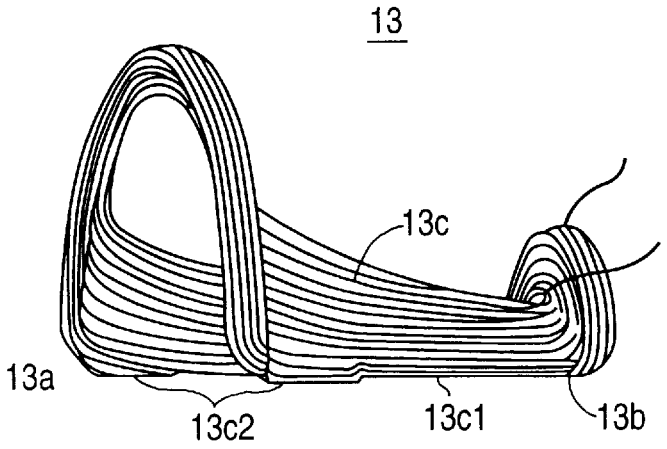
FIG. 10 shows a perspective view of a horizontal deflection coil of second embodiment of the present invention.

FIG. 10 shows a perspective view of a horizontal deflection coil of second embodiment of the present invention.

Figure 5:
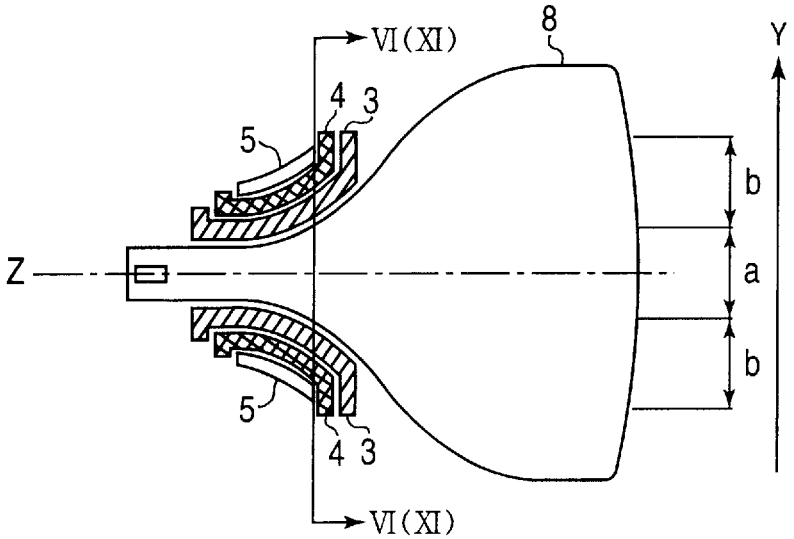
Fig. 5 PRIOR ART
FIG. 5 shows a sectional view of a deflection yoke and a color picture tube of the prior art.
Figure 11:
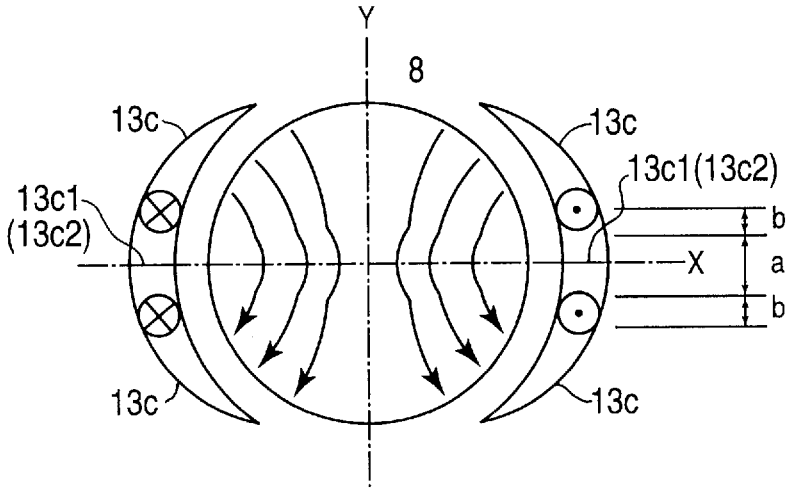
FIG. 11 shows a sectional view of a pair of horizontal deflection coils and a color picture tube of the present invention taken along line A–A' of FIG. 5 and modified to show the features of the present invention.

FIG. 11 shows a sectional view of a pair of horizontal deflection coils and a color picture tube of the present invention taken along line A–A' of FIG. 5 and modified to show the features of the present invention.

Figure 12A:
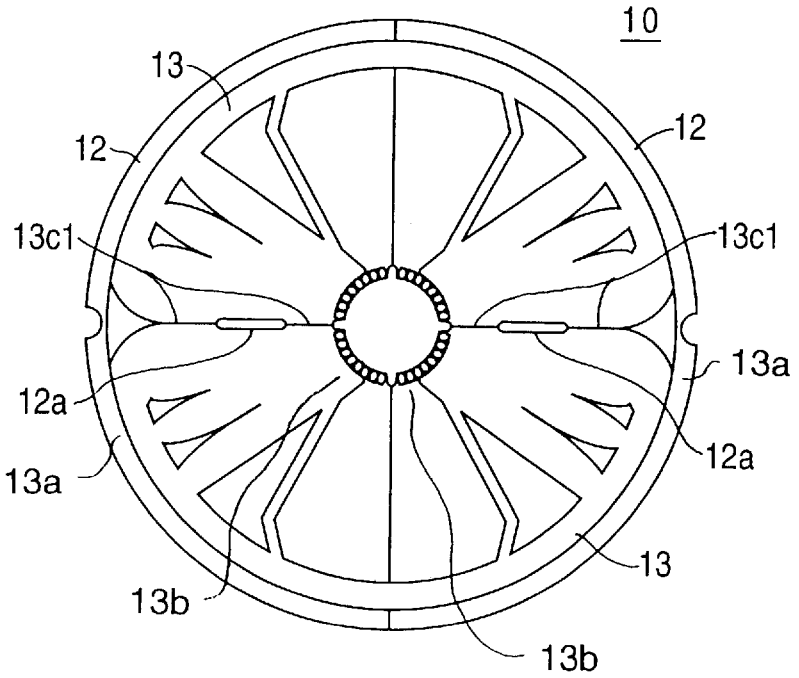
FIGS. 12(A) and 12(B) show frontal and sectional views of a deflection yoke of third embodiment of the present invention.
Figure 12B:
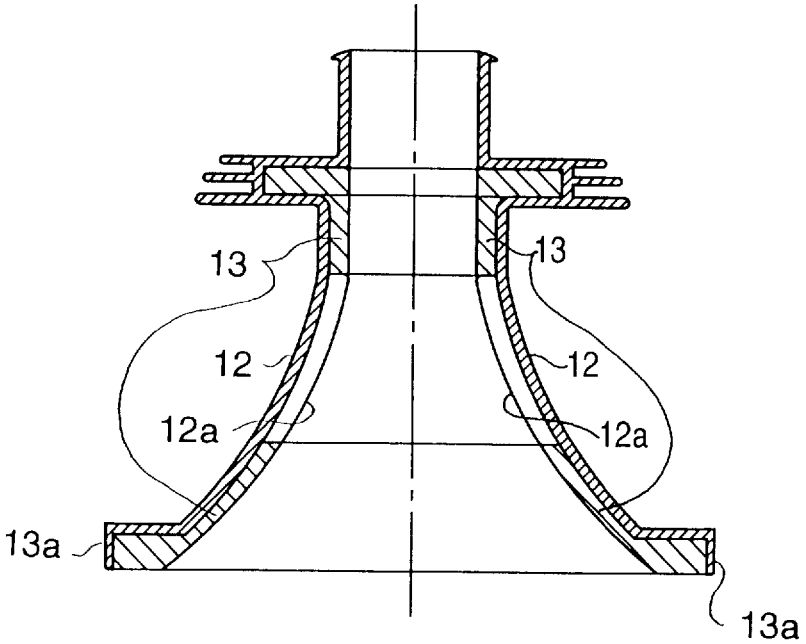

FIGS. 12(A) and 12(B) show frontal and sectional views of a deflection yoke of third embodiment of the present invention.

Figure 13A:
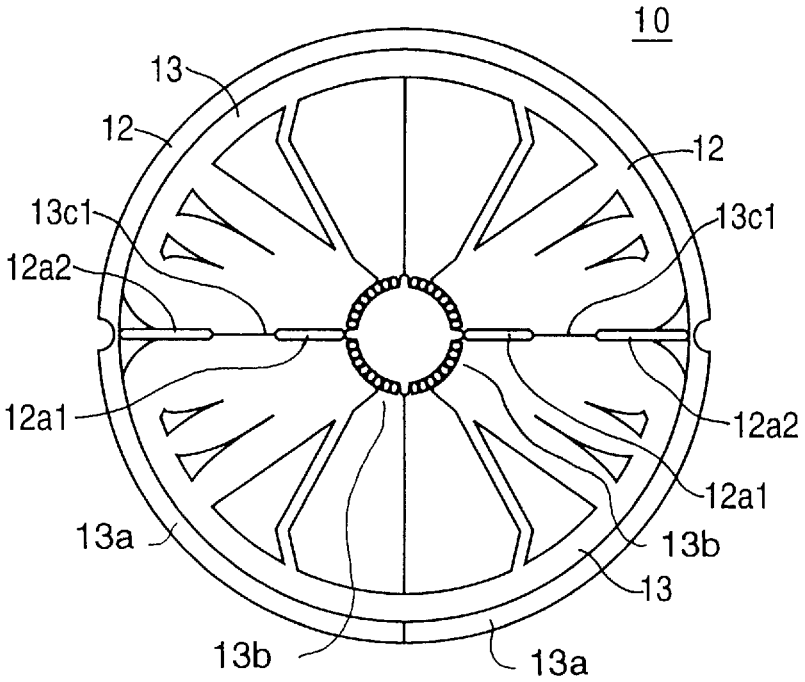
FIGS. 13(A) and 13(B) show frontal and sectional views of a deflection yoke of fourth embodiment of the present invention.
Figure 13B:
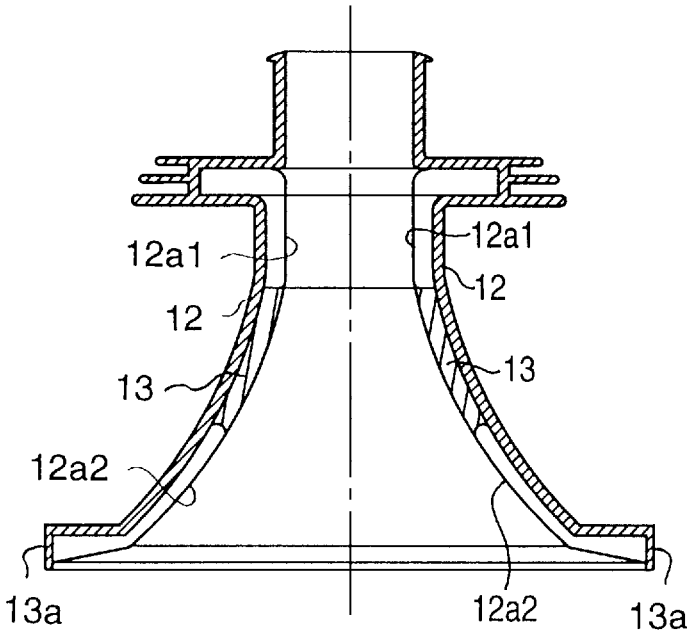

FIGS. 13(A) and 13(B) show frontal and sectional views of a deflection yoke of fourth embodiment of the present invention.

Figure 14A:
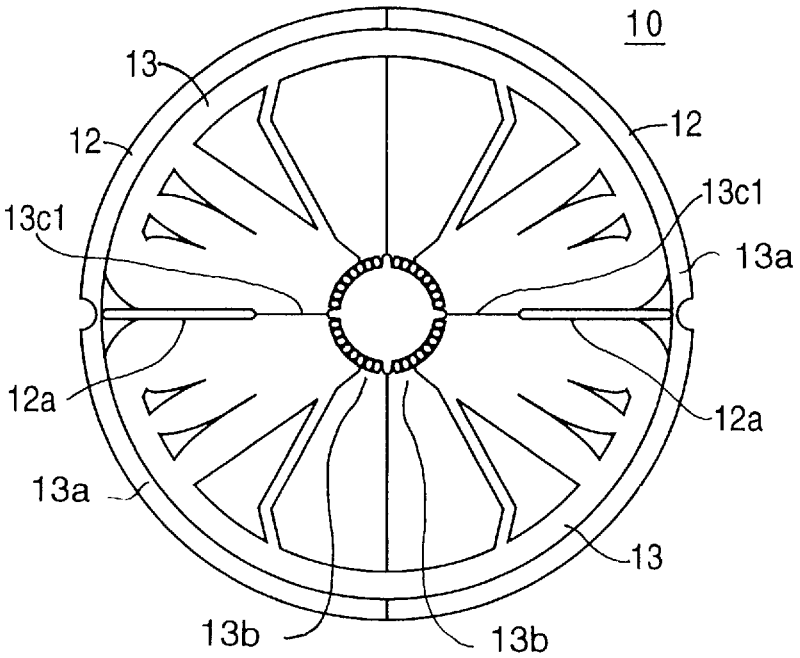
FIGS. 14(A) and 14(B) show frontal and sectional views of a deflection yoke of fifth embodiment of the present invention.
Figure 14B:
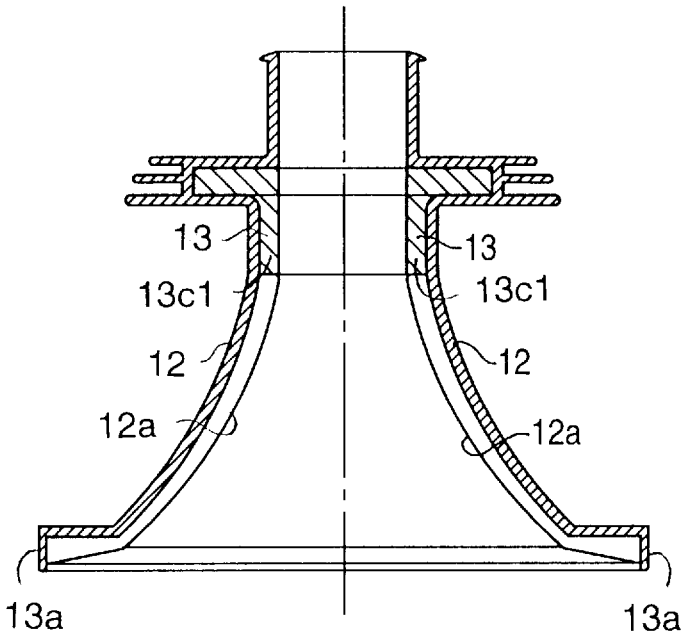

FIGS. 14(A) and 14(B) show frontal and sectional views of a deflection yoke of fifth embodiment of the present invention.

Figure 15A:
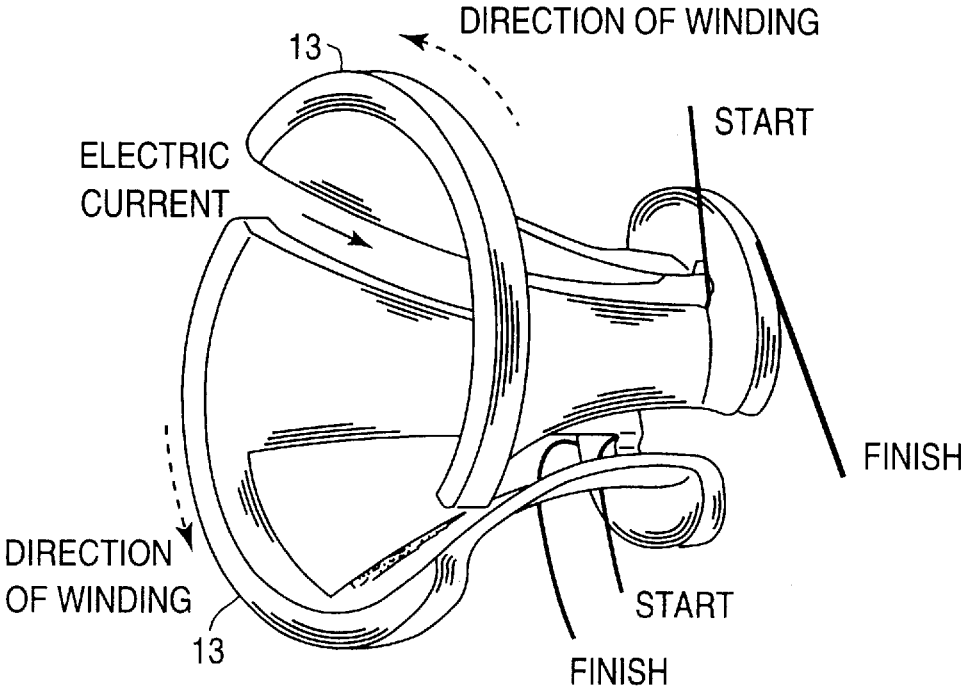
FIG. 15(A) shows a perspective view of a pair of horizontal deflection coils for explaining a way of winding.

FIG. 15(A) shows a perspective view of a pair of horizontal deflection coils for explaining a way of winding.

Figure 15B:
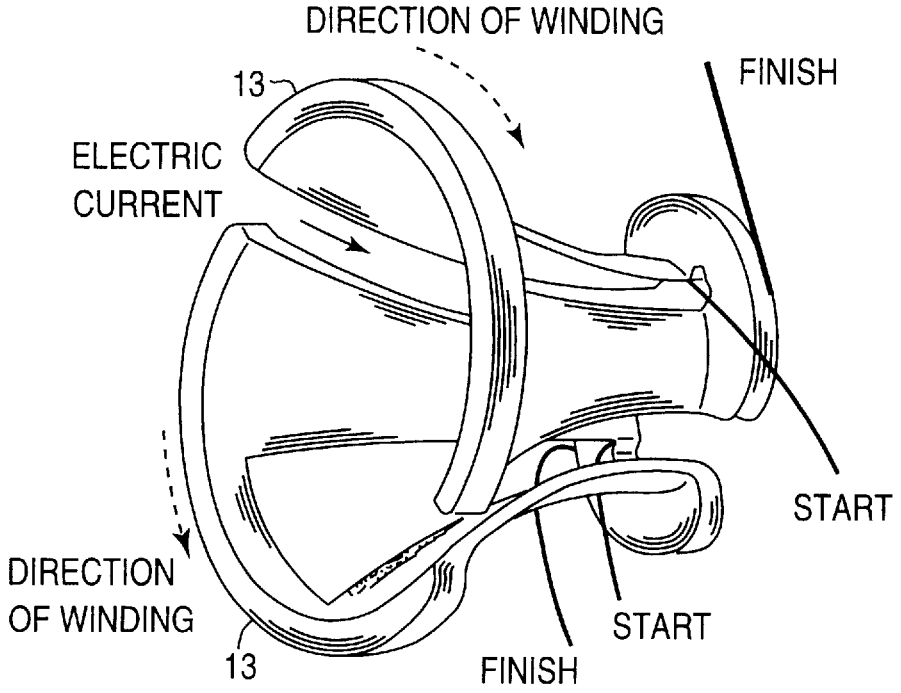
FIG. 15(B) shows a perspective view of a pair of horizontal deflection coils for explaining another method of winding.

FIG. 15(B) shows a perspective view of a pair of horizontal deflection coils for explaining another way of winding.

A deflection yoke of the present invention is almost same as a deflection yoke of the prior art shown in FIG. 1 in most of its constructions except for its horizontal deflection coils and separator. Accordingly, explanations will be given to the horizontal deflection coils and the separator, and omitted for others.

[First Embodiment]

An explanation will be given to a first embodiment of the present invention.

FIG. 8 shows a frontal view of a deflection yoke 10 of first embodiment of the present invention seen from the side of a large brim.

A pair of separators 12, 12 (left and right) and a pair of horizontal deflection coils 13, 13 (upper and lower) are shown in FIG. 8.

Horizontal deflection coils 13, 13 are provided inside of and upper and lower sides of the pair of separators 12, 12 respectively. The pair of horizontal deflection coils 13, 13 has a large rim 13*a*, 13*a*, a small rim 13*b*, 13*b*, an intermediate portion 13*c*, 13*c*, pressed planes 13*c*1, 13*c*1 on respective sides thereof, and a window 13*d*, 13*d* interposed between the intermediate portions 13*c*, 13*c*.

The pair of separators 12, 12 of a deflection yoke 10 of the first embodiment has no ribs for separating the pressed planes 13*c*1, 13*c*1 each other at some distance away as shown in FIG. 8, and the pressed planes 13*c*1, 13*c*1 are electrically insulated but physically and directly confronting each other across an air gap. The distance between the pressed planes 13*c*1, 13*c*1 is preferable to be less than 1 mm, more preferable to be 0.7 mm, and the best to contact firmly.

[Second Embodiment]

FIGS. 9(A) and 9(B) show respectively frontal and sectional views of a deflection yoke 10 of second embodiment of the present invention seen from a front and a top of the deflection yoke 10.

In the second embodiment, as shown in FIGS. 9(A) and 9(B), ribs 12*a*, 12*a* are provided partly between the pressed planes 13*c*1, 13*c*1, so that the upper and lower horizontal deflection coils 13, 13 are kept apart each other where the ribs 12*a*, 12*a* are present. The ribs 12*a*, 12*a* extend along the pressed planes 13*c*1, 13*c*1 from the small rim 13*b* (rear of the deflection yoke 10) toward the large rim 13*a* (front) but are terminated at a halfway between them, so that the pressed planes 13*c*1, 13*c*1 confront directly each other in vicinity of the large rim 13*a* as shown by hatching in FIG. 9(B).

FIG. 10 shows a perspective view of a horizontal deflection coil of second embodiment of the present invention.

A horizontal deflection coil 13 of the second embodiment has a projection 13*c*2 which is a part of winding of the pressed plane 13*c*1, the projection 13*c*2 is disposed close to the large rim 13*a* when assembled thereto. When the pair of horizontal deflection coils 13, 13 of the second embodiment is provided on the pair of separators 12, 12 of FIG. 9(A), these projections 13*c*2 are directly confronting each other. The projection 13*c*2 and other edges of the horizontal coil 13 are formed by a pressing process called a "stepped press" work.

An electron beam of a color picture tube 8 is deflected more at the position of the large rim 13*a* than at the small rim 13*b* thereof. As the pressed plane 13*c*1 of the second embodiment is directly contacting with the another pressed plane 13*c*1, a magnitude of deflection caused at the contacting area is enhanced relatively.

FIG. 11 shows a sectional view of a pair of horizontal deflection coils and a color picture tube of the present invention taken along line A–A' of FIG. 5 and modified to show the features of the present invention.

Figure 6:
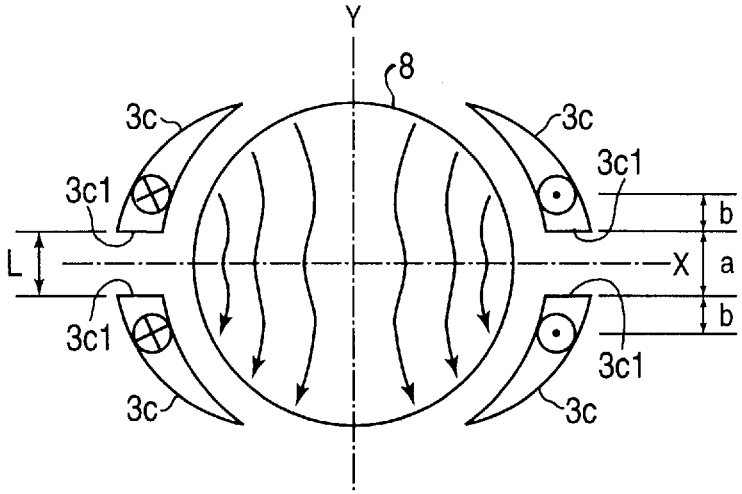
Fig. 6 PRIOR ART
FIG. 6 shows a sectional view of a pair of horizontal deflection coils and a color picture tube of the prior art taken along line A–A' of FIG. 5.

In FIG. 11, a magnetic field induced by the pair of horizontal deflection coils 13, 13 is shown. At the area near the large rim 13*a* , the pressed planes 13*c*1, 13*c*1 confront each other. This is a modification of the cross-section of FIG. 5 to illustrate the features of the present invention. Therefore, a pincushion magnetic field is stronger in the area "a" than that of the prior art (FIG. 6), and is less in the area "b". Accordingly, the horizontal deflection coil 13 of the second embodiment improves a "B" type misconvergence shown in FIG. 7.

[Third Embodiment]

FIGS. 12(A) and 12(B) show frontal and sectional views of a deflection yoke 10 of third embodiment of the present invention seen from a front and a top of the deflection yoke 10.

In the third embodiment, the ribs 12*a*, 12*a* are provided only in a mid area between the large and small rims 13*a* and 13*b* as shown in FIG. 12(B), so that the pressed planes 13*c*1, 13*c*1 confront directly each other in vicinities of the large and small rims 13*a* and 13*b* as hatched areas in FIG. 12(B).

[Fourth Embodiment]

FIGS. 13(A) and 13(B) show respectively frontal and sectional views of a deflection yoke of fourth embodiment of the present invention seen from a front and a top of the deflection yoke 10.

In the fourth embodiment, 2 sets of ribs are provided. As shown in FIG. 13(B), ribs 12*a*1, 12*a*1 extend from the vicinity of the small rim 13*b* and are terminated short of a mid point between the large and small rims 13*a* and 13*b*, another set of ribs 12*a*2, 12*a*2 extend from the vicinity of the large rim 13*a* and are terminated short of the mid point leaving the mid area for a direct facing of the pressed planes 13*c*1, 13*c*1 as shown by hatching in FIG. 13(B).

[Fifth Embodiment]

FIGS. 14(A) and 14(B) show respectively frontal and sectional views of a deflection yoke of fifth embodiment of the present invention seen from a front and a top of the deflection yoke 10.

In the fifth embodiment, the ribs 12*a*, 12*a* are provided extending from a vicinity of the large rim 13*a* beyond the mid point but short of the small rim 13*b*, so that the pressed planes 13*c*1, 13*c*1 confront directly each other in vicinity of the small rim 13*b* as hatched area shown in FIG. 14(*b*).

In the second through fifth embodiments, a parted distance between the pressed planes 13*c*1, 13*c*1 is equal to a thickness of the ribs 12*a*, 12*a*, therefore, by varying the thickness, the parted distance between the pressed planes 13*c*1, 13*c*1 can be controlled in a range from the thickness of the ribs 12*a*, 12*a* to zero distance where no ribs are present, that is, they contact each other directly without a rib. As an example, thickness of the ribs 12*a*1 and 12*a*2 in the fourth embodiment are 3 mm at a front end of the rib 12*a*2 and slightly less than 2 mm at a rear end of the rib 12*a*1.

In addition to the thickness of the ribs 12*a*, 12*a*, an area to allow the direct contact of the pressed planes 13*c*1, 13*c*1 can be controlled by changing a width, length and location of the ribs 12*a*, 12*a* in positional relationship of the pressed planes 13*c*1, 13*c*1, consequently, the magnetic field induced by the horizontal deflection coils 13, 13 can be controlled according to a configuration of these ribs 12*a*, 12*a* as a design option. The rib 12*a* may be molded as an integral part of the separator 12 or a separate piece.

Figure 4:
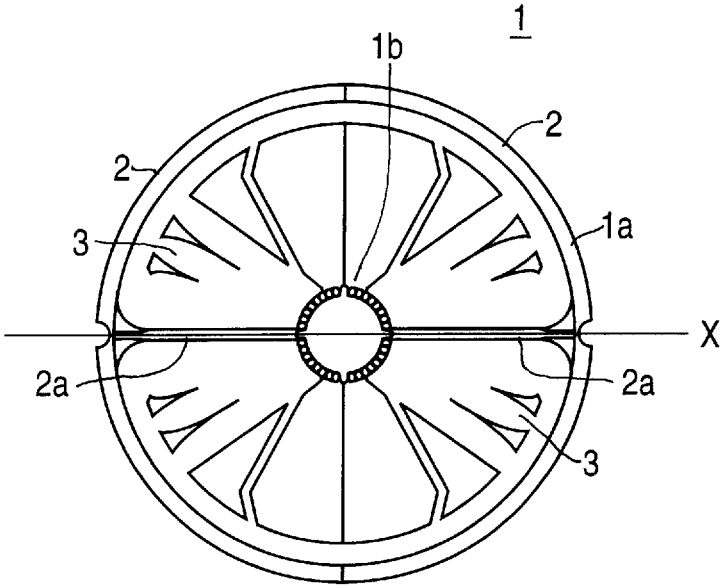
Fig. 4 PRIOR ART
FIG. 4 shows a frontal view of a deflection yoke of the prior art seen from the side of a large brim.
Figure 7:
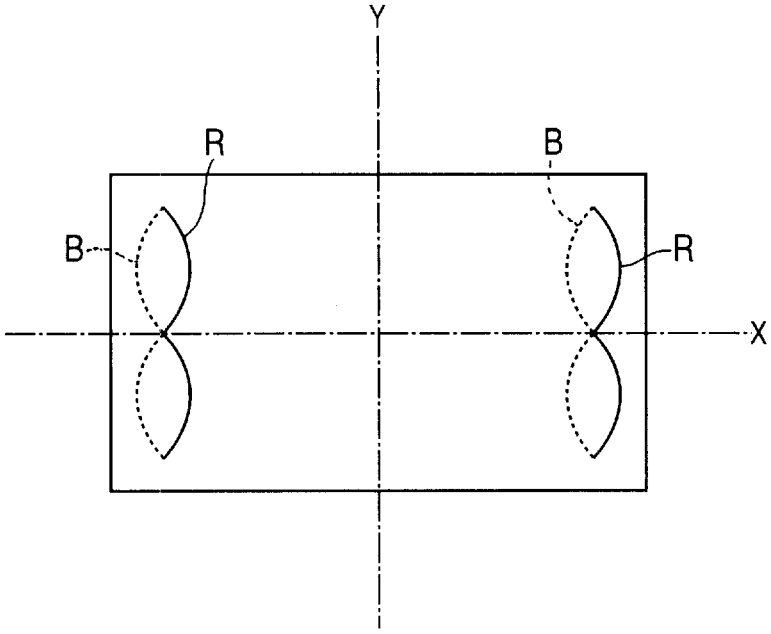
Fig. 7 PRIOR ART
FIG. 7 shows a screen of a color picture tube for explaining a misconvergence of the prior art.

The pair of horizontal deflection coils 13, 13 of the first through fifth embodiments improves a misconvergence shown in FIG. 7, as pressed planes 13*c*1, 13*c*1 contact with at least partly each other. The pressed planes 13*c*1, 13*c*1 of the present invention are disposed closer each other than those of the prior art shown in FIG. 4. This means an increase of space available for accommodating wires of the horizontal deflection coils 13, 13, in turn, this presents more design flexibility of coil formation, that is a physical arrangement of coil wires in the area "a". Otherwise, the area "a" is considerably taken up by the ribs 2*a*, 2*a* of more than 1 mm thick, in the case of the prior art. As a result, the deflection yoke 10 of the present invention can reduce not only the "B" type misconvergence, but also another type of misconvergence and a raster distortion.

Since the deflection yoke 10 of second through fifth embodiments has ribs 12*a*, 12*a* on the separator 12, which serves as a positioner, it is easy to mount the horizontal deflection coils 13, 13 on the separator 12.

When the pressed planes 13*c*1, 13*c*1 physically contact each other, it is important to secure electronic insulation between the horizontal deflection coils 13, 13 by increasing a dielectric strength thereof or winding them reversely each other called "reverse winding" to reduce an electric potential difference therebetween.

Next, normal and reverse windings will be explained referring to FIGS. 15(A) and 15(B). FIG. 15(A) shows horizontal deflection coils 13, 13 wound in a same direction respectively. FIG. 15(B) shows horizontal deflection coils 13, 13 wound reversely each other.

In FIG. 15(A), a start terminal of the upper horizontal deflection coil 13 is connected to a finish terminal of the lower horizontal deflection coil 13, and a finish terminal of the upper horizontal deflection coil 13 is connected to a start terminal of the lower horizontal deflection coil 13. When an electric current flows to the pair of deflection coils 13, 13, an electric potential is produced between the pressed planes 13*c*1, 13*c*1.

In FIG. 15(B), the start terminal of the upper horizontal deflection coil 13 is connected to the start terminal of the lower horizontal deflection coil 13, and the finish terminal of the upper horizontal deflection coil 13 is connected to the finish terminal of the lower horizontal deflection coil 13. By this connecting arrangement, no electric potential difference is produced between the pressed planes 13*c*1, 13*c*1. Thus, there occurs no insulation break down on the pressed planes 13*c*1, 13*c*1.

The advantage of the present invention is to be capable of reducing the "B" type misconvergence by providing the pressed planes physically and directly contacting each other.

The another advantage of the present invention is to be capable of reducing other kind of misconvergence and the raster distortion by improving the space factor of the pressed plane and the productivity of the deflection yoke.

What is claimed is:

1. A deflection yoke comprising:

a pair of saddle type horizontal deflection coils having large and small diameter rims at front and rear ends thereof respectively;

a pair of vertical deflection coils;

a separator interposed between said pair of horizontal deflection coils and said pair of vertical deflection coils for insulating said pairs of coils from each other;

rib means formed on parts of said separator and interposed between said pair of horizontal deflection coils; and each of said pair of horizontal deflection coils respectively having a confronting end which confronts the end of the other horizontal coil, wherein said confronting ends ar electrically insulated from each other but physically and directly face each other and are spaced from each other by a distance smaller than the thickness of said rib means where said rib means is not formed on said separator.

2. A deflection yoke comprising;

a pair of saddle type horizontal deflection coils having large and small diameter rims at front and rear ends thereof respectively;

a pair of vertical deflection coils;

a separator interposed between said pair of horizontal deflection coils and said pair of vertical deflection coils for insulating said pairs of coils from each other; and each of said pair of horizontal deflection coils respectively having a confronting end which confronts the end of the other horizontal deflection coil, wherein said confronting ends of said horizontal deflection coils are electrically insulated from each other but physically and at least partially directly face each other, and wherein said confronting ends of said horizontal deflection coils at least partially directly face each other in a limited vicinity extending from said small diameter rim.

3. A deflection yoke comprising;

a pair of saddle type horizontal deflection coils having large and small diameter rims at front and rear ends thereof respectively;

a pair of vertical deflection coils;

a separator interposed between said pair of horizontal deflection coils and said pair of vertical deflection coils for insulating said pairs of coils from each other; and each of said pair of horizontal deflection coils respectively having a confronting end which confronts the end of the other horizontal deflection coil, wherein said confronting ends of said horizontal deflection coils are electrically insulated from each other but physically and at least partially directly face each other, and wherein said confronting ends of said horizontal deflection coils at least partially directly face each other in a limited vicinity located at a mid area between said large and small diameter rims.

4. A deflection yoke comprising;

a pair of saddle type horizontal deflection coils having large and small diameter rims at front and rear ends thereof respectively;

a pair of vertical deflection coils;

a separator interposed between said pair of horizontal deflection coils and said pair of vertical deflection coils for insulating said pairs of coils from each other; and each of said Pair of horizontal deflection coils respectively having a confronting end which confronts the end of the other horizontal deflection coil, wherein said confronting ends of said horizontal deflection coils are electrically insulated from each other but physically and at least partially directly face each other, and wherein said confronting ends of said horizontal deflection coils directly face each other in limited vicinities extending from said large and small diameter rims respectively.

5. A deflection yoke comprising;

a pair of saddle type horizontal deflection coils having large and small diameter rims at front and rear ends thereof respectively;

a pair of vertical deflection coils;

a separator interposed between said pair of horizontal deflection coils and said pair of vertical deflection coils for insulating said pairs of coils from each other; and each of said pair of horizontal deflection coils respectively having a confronting end which confronts the end of the other horizontal deflection coil, wherein said confronting ends of said horizontal deflection coils are electrically insulated from each other but physically and at least partially directly face each other, and wherein said confronting ends of said horizontal deflection coils at least partially and directly are spaced from each other a distance of 1 mm or less.

6. A deflection yoke comprising:

a pair of saddle type horizontal deflection coils having large and small diameter rims at front and rear ends thereof respectively;

a pair of vertical deflection coils;

a separator interposed between said pair of horizontal deflection coil and said pair of vertical deflection coils for insulating said pair of coils from each other;

each of said Pair of horizontal deflection coils respectively having a confronting end which confronts the end of the other horizontal deflection coil, wherein said confronting ends of said horizontal deflection coils are electrically insulated from each other but physically and at least partially directly face each other; and means for producing a substantially zero electric potential difference between said confronting ends, wherein said means includes each of said pair of horizontal deflection coils being wound respectively in a different direction from the other.

7. A deflection yoke comprising;

a pair of saddle type horizontal deflection coils having large and small diameter rims at front and rear ends thereof respectively;

a pair of vertical deflection coils;

a separator interposed between said pair of horizontal deflection coils and said pair of vertical deflection coils for insulating said pair coils from each other;

each of said pair of horizontal deflection coils respectively having a confronting end which confronts the end of the other horizontal deflection coil, wherein said confronting ends of said horizontal deflection coils are electrically insulated from each other but physically and at least partially directly face each other, and wherein said confronting ends are close to each other in the vicinity of said large diameter rim; and means for producing a substantially zero electric potential difference between said confronting ends, wherein said means includes each of said pair of horizontal deflection coils being wound respectively in a different direction from the other.

8. A deflection yoke comprising;

a pair of saddle type horizontal deflection coils having large and small diameter rims at front and rear ends thereof respectively;

a pair of vertical deflection coils;

a separator interposed between said pair of horizontal deflection coils and said pair of vertical deflection coils for insulating said pairs of coils from each other;

each of said pair of horizontal deflection coils respectively having a confronting end which confronts the end of the other horizontal deflection coil, wherein said confronting ends of said horizontal deflection coils are electrically insulated from each other but physically and at least partially directly face each other; and ribs interposed between said confronting ends of said horizontal deflection coils for physically separating said confronting ends from each other except for an area where said confronting ends directly face each other.

* * * * *